US006982671B2

(12) United States Patent
Killen et al.

(10) Patent No.: US 6,982,671 B2
(45) **Date of Patent: *Jan. 3, 2006**

(54) SLOT FED MICROSTRIP ANTENNA HAVING ENHANCED SLOT ELECTROMAGNETIC COUPLING

(75) Inventors: William D. Killen, Melbourne, FL (US); Randy T. Pike, Grant, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/373,935

(22) Filed: Feb. 25, 2003

(65) Prior Publication Data

US 2004/0164907 A1 Aug. 26, 2004

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS

| | | | |
|---|---|---|---|
| 3,571,722 A | 3/1971 | Vendelin | 333/25 |
| 3,581,243 A | 5/1971 | Alford | |
| 3,678,418 A | 7/1972 | Woodward | 333/26 |

(Continued)

FOREIGN PATENT DOCUMENTS

| | | |
|---|---|---|
| EP | 0 754 660 A1 | 1/1997 |
| EP | 1 089 374 A2 | 4/2001 |
| EP | 1 108 533 | 6/2001 |
| JP | 56-123102 | 9/1981 |
| JP | 05-211402 | 8/1983 |
| JP | 07-015218 | 1/1995 |
| JP | 08-154006 | 6/1996 |
| JP | 08 307117 | 11/1996 |
| JP | 10/190321 | 7/1998 |
| JP | 2000307362 | 11/2000 |
| WO | WO 01-01453 A2 | 1/2001 |

OTHER PUBLICATIONS

U.S. Appl. No. 10/448,973, filed May 30, 2003, Delgado, et al.
U.S. Appl. No. 10/184,277, filed Jun. 27, 2002, Killen, et al.
U.S. Appl. No. 10/185,443, filed Jun. 27, 2002, Killen, et al.
U.S. Appl. No. 10/184,332, filed Jun. 27, 2002, Killen, et al.
U.S. Appl. No. 10/185,251, filed Jun. 27, 2002, Parsche, et al.
U.S. Appl. No. 10/185,847, filed Jun. 27, 2002, Killen, et al.
U.S. Appl. No. 10/185,275, filed Jun. 27, 2002, Killen, et al.
U.S. Appl. No. 10/185,273, filed Jun. 27, 2002, Killen, et al.
U.S. Appl. No. 10/308,500, filed Dec. 3, 2002, Killen, et al.
U.S. Appl. No. 10/404,285, filed Mar. 31, 2003, Killen, et al.
U.S. Appl. No. 10/404,981, Mar. 31, 2003, Killen, et al.
U.S. Appl. No. 10/404,960, filed Mar. 31, 2003, Killen, et al.
U.S. Appl. No. 10/185,144, filed Jun. 27, 2002, Killen, et al.

(Continued)

*Primary Examiner*—Michael C. Wimer
(74) *Attorney, Agent, or Firm*—Sacco & Associates PA

(57) ABSTRACT

A slot fed microstrip antenna (100) provides improved efficiency through enhanced coupling of electromagnetic energy between the feed line (117) and the slot (106). The dielectric layer (105) between the feed line (117) and the slot (106) includes magnetic particles (114), the magnetic particles (114) preferably included in the dielectric junction region (113) between the microstrip feed line (117) and the slot (106). A high dielectric region is preferably also provided in the junction constant to further enhance the field concentration effect. The slot antenna (100) can be embodied as a microstrip patch antenna (200).

15 Claims, 6 Drawing Sheets

U.S. PATENT DOCUMENTS

| | | | | | |
|---|---|---|---|---|---|
| 3,681,716 | A | | 8/1972 | Chiron et al. | |
| 4,495,505 | A | | 1/1985 | Shields | 343/821 |
| 4,525,720 | A | | 6/1985 | Corzine et al. | 343/895 |
| 4,638,271 | A | | 1/1987 | Jecko et al. | |
| 4,800,344 | A | | 1/1989 | Graham | 333/25 |
| 4,825,220 | A | | 4/1989 | Edward et al. | 343/795 |
| 4,882,553 | A | | 11/1989 | Davies et al. | 333/26 |
| 4,916,410 | A | | 4/1990 | Littlefield | 333/295 |
| 4,924,236 | A | | 5/1990 | Schuss et al. | 343/700 MS |
| 4,967,171 | A | | 10/1990 | Ban et al. | |
| 5,039,891 | A | | 8/1991 | Wen et al. | 333/25 |
| 5,148,130 | A | | 9/1992 | Dietrich | 307/529 |
| 5,379,006 | A | | 1/1995 | McCorkle | 333/26 |
| 5,455,545 | A | | 10/1995 | Garcia | 333/26 |
| 5,515,059 | A | * | 5/1996 | How et al. | 342/372 |
| 5,523,728 | A | | 6/1996 | McCorkle | 333/128 |
| 5,678,219 | A | | 10/1997 | Agarwal et al. | 455/280 |
| 5,714,112 | A | | 2/1998 | Hazeyama et al. | |
| 5,952,972 | A | * | 9/1999 | Ittipiboon et al. | 343/700 MS |
| 6,052,039 | A | | 4/2000 | Chiou et al. | 333/100 |
| 6,114,940 | A | | 9/2000 | Kakinuma et al. | 336/233 |
| 6,133,806 | A | | 10/2000 | Sheen | 333/26 |
| 6,137,376 | A | | 10/2000 | Imbornone et al. | 333/25 |
| 6,184,845 | B1 | | 2/2001 | Leisten et al. | 343/895 |
| 6,281,845 | B1 | | 8/2001 | Ittipiboon et al. | 343/700 MS |
| 6,307,509 | B1 | | 10/2001 | Krantz | 343/700 MS |
| 6,842,140 | B2 | * | 1/2005 | Killen et al. | 343/700 |

OTHER PUBLICATIONS

U.S. Appl. No. 10/185,266, filed Jun. 27, 2002, Killen, et al.

U.S. Appl. No. 10/185,162, filed Jun. 27, 2002, Rumpf, Jr., et al.

U.S. Appl. No. 10/185,824, filed Jun. 27, 2002, Killen, et al.

U.S. Appl. No. 10/185,187, filed Jun. 27, 2002, Killen, et al.

U.S. Appl. No. 10/185,855, filed Jun. 27, 2002, Killen, et al.

U.S. Appl. No. 10/185,459, filed Jun. 27, 2002, Killen, et al.

U.S. Appl. No. 10/185,480, filed Jun. 27, 2002, Killen, et al.

U.S. Appl. No. 10/439,094, filed May 15, 2003, Delgado, et al.

Itoh, T.; et al., "Metamaterials Structures, Phenomena and Applications" IEEE Transactions on Microwave Theory and Techniques; Apr. 2005; [Online]Retrieved from the Internet: URL:www.mtt.org/publications/Transactions/CFP__ Metamaterials.pdf>.

Kiziltas, G.; et al: "Metamaterial design via the density method" IEEE Antennas and Propagation Society Int'l Symposium 2002, vol. 1, Jun. 16, 2002 pp. 748–751, Piscataway.

Salahun, E,: et al., "Ferromagnetic composite–based and magnetically–tunable microwave devices" IEEE MTT–S Microwave Symposium Digest, vol. 2, Jun. 2, 2002 pp. 1185–1188.

* cited by examiner

SLOT FED MICROSTRIP ANTENNA HAVING ENHANCED SLOT ELECTROMAGNETIC COUPLING

STATEMENT OF THE TECHNICAL FIELD

The inventive arrangements relate generally microstrip slot antennas.

DESCRIPTION OF THE RELATED ART

RF circuits, transmission lines and antenna elements are commonly manufactured on specially designed substrate boards. Conventional circuit board substrates are generally formed by processes such as casting or spray coating which generally result in uniform substrate physical properties, including the dielectric constant.

For the purposes RF circuits, it is generally important to maintain careful control over impedance characteristics. If the impedance of different parts of the circuit do not match, signal reflections and inefficient power transfer can result. Electrical length of transmission lines and radiators in these circuits can also be a critical design factor.

Two critical factors affecting circuit performance relate to the dielectric constant (sometimes referred to as the relative permittivity or $\in_r$) and the loss tangent (sometimes referred to as the dissipation factor or $\delta$) of the dielectric substrate material. The dielectric constant determines the electrical wavelength in the substrate material, and therefore the electrical length of transmission lines and other components disposed on the substrate. The loss tangent determines the amount of signal loss that occurs for signals traversing the substrate material. Losses tend to increase with increases in frequency. Accordingly, low loss materials become even more important with increasing frequency, particularly when designing receiver front ends and low noise amplifier circuits.

Printed transmission lines, passive circuits and radiating antenna elements used in RF circuits are typically formed in one of three ways. One configuration known as microstrip, places the signal line on a board surface and provides a second conductive layer, commonly referred to as a ground plane. A second type of configuration known as buried microstrip is similar except that the signal line is covered with a dielectric substrate material. In a third configuration known as stripline, the signal line is sandwiched between two electrically conductive (ground) planes.

In general, the characteristic impedance of a parallel plate transmission line, such as stripline or microstrip line, is equal to $\sqrt{L_1/C_1}$, where $L_1$ is the inductance per unit length and $C_1$ is the capacitance per unit length. The values of $L_1$ and $C_1$ are generally determined by the physical geometry and spacing of the line structure as well as the dielectric constant of the dielectric material(s) used to separate the transmission lines.

In conventional RF designs, a substrate material is selected that has a single dielectric constant and relative permeability value, the relative permeability value being about 1. Once the substrate material is selected, the line characteristic impedance value is generally exclusively set by controlling the geometry of the line, the slot, and coupling characteristics of the line and the slot.

Radio frequency (RF) circuits are typically embodied in hybrid circuits in which a plurality of active and passive circuit components are mounted and connected together on a surface of an electrically insulating board substrate, such as a ceramic substrate. The various components are generally interconnected by printed metallic conductors, such as copper, gold, or tantalum, which generally function as transmission lines (e.g. stripline or microstrip line or twin-line) in the frequency ranges of interest.

The dielectric constant of the selected substrate material for a transmission line, passive RF device, or radiating element determines the physical wavelength of RF energy at a given frequency for that structure. One problem encountered when designing microelectronic RF circuitry is the selection of a dielectric board substrate material that is reasonably suitable for all of the various passive components, radiating elements and transmission line circuits to be formed on the board.

In particular, the geometry of certain circuit elements may be physically large or miniaturized due to the unique electrical or impedance characteristics required for such elements. For example, many circuit elements or tuned circuits may need to have an electrical length of a quarter of a wavelength. Similarly, the line widths required for exceptionally high or low characteristic impedance values can, in many instances, be too narrow or too wide for practical implementation for a given substrate. Since the physical size of the microstrip line or stripline is inversely related to the dielectric constant of the dielectric material, the dimensions of a transmission line or a radiator element can be affected greatly by the choice of substrate board material.

Still, an optimal board substrate material design choice for some components may be inconsistent with the optimal board substrate material for other components, such as antenna elements. Moreover, some design objectives for a circuit component may be inconsistent with one another. For example, it may be desirable to reduce the size of an antenna element. This could be accomplished by selecting a board material with a high dielectric constant with values such as 50 to 100. However, the use of a dielectric with a high dielectric constant will generally result in a significant reduction in the radiation efficiency of the antenna.

Antenna elements are sometimes configured as microstrip slot antennas. Microstrip slot antennas are useful antennas since they generally require less space, are simpler and are generally less expensive to manufacture as compared to other antenna types. In addition, importantly, microstrip slot antennas are highly compatible with printed-circuit technology.

One factor in constructing a high efficiency microstrip slot antenna is minimizing the power loss, which may be caused by several factors including dielectric loss. Dielectric loss is generally due to the imperfect behavior of bound charges, and exists whenever a dielectric material is placed in a time varying electromagnetic field. The dielectric loss, often referred as loss tangent, is directly proportional to the conductivity of the dielectric medium. Dielectric loss generally increases with operating frequency.

The extent of dielectric loss for a particular microstrip slot antenna is primarily determined by the dielectric constant of the dielectric space between the radiator antenna element (e.g., slot) and the feed line. Free space, or air for most purposes, has a dielectric constant and relative permeability approximately equal to one.

A dielectric material having a dielectric constant close to one is considered a "good" dielectric material as a good dielectric material exhibits low dielectric loss at the operating frequency of interest. When a dielectric material having a dielectric constant substantially equal to the surrounding materials is used, the dielectric loss due to impedance mismatches is effectively eliminated. Therefore, one method for maintaining high efficiency in a microstrip slot antenna system involves the use of a material having a low dielectric constant in the dielectric space between the radiator antenna slot and the microstrip feed line exciting the slot.

Furthermore, the use of a material with a lower dielectric constant permits the use of wider transmission lines that, in turn, reduce conductor losses and further improve the radiation efficiency of the microstrip slot antenna. However, the use of a dielectric material having a low dielectric constant can present certain disadvantages, such as the large size of the slot antenna fabricated on a low dielectric constant substrate as compared to a slot antenna fabricated on a high dielectric constant substrate.

The efficiency of microstrip slot antennas is compromised through the selection of a particular dielectric material for the feed which has a single uniform dielectric constant. A low dielectric constant is helpful in allowing wider feed lines, that result in a lower resistive loss, to the minimization of the dielectric induced line loss, and the minimization of the slot radiation efficiency. However, available dielectric materials when placed in the junction region between the slot and the feed result in reduced antenna radiation efficiency due to the poor coupling characteristics through the slot.

SUMMARY OF THE INVENTION

The invention provides microstrip slot antennas having improved efficiency through enhanced coupling of electromagnetic energy between the feed line and the slot. Specifically, through manipulation of the dielectric constant and permeability of the dielectric substrate in the dielectric region underlying the slot, the Q, the radiation efficiency, the impedance and other electromagnetic characteristics of the antenna can be enhanced.

A slot fed microstrip antenna includes an electrically conducting ground plane, the ground plane having at least one slot. A microstrip feed line provides signal energy through or from the slot. A first dielectric substrate material is disposed between the feed line and the ground plane. At least a portion of the first dielectric substrate includes magnetic particles, the magnetic particles preferably being provided in the junction region between the feed line and the slot.

Dielectrics substrates used previously for microwave circuit board substrates have been mostly nonmagnetic. Examples of existing magnetic substrates are the ferrite crystals. Nonmagnetic is defined as having a relative permeability of 1 ($\mu_r$=1).

In engineering applications, the permeability is often expressed in relative, rather than in absolute, terms. The relative permeability of the material in question is the ratio of the material permeability to the permeability of free space, that is $\mu_r=\mu/\mu_0$. The permeability of free space is represented by the symbol $\mu_0$ and it has a value of $1.257\times 10^{-6}$ H/m.

Magnetic materials are materials having a relative permeability $\mu_r$ either greater than 1, or less than 1. Magnetic materials are commonly classified into the three groups described below.

Diamagnetic materials are materials which have a relative permeability of less than one, but typically from 0.99900 to 0.99999. For example, bismuth, lead, antimony, copper, zinc, mercury, gold, and silver are known diamagnetic materials. Accordingly, when subjected to a magnetic field, these materials produce a slight decrease in the magnetic flux density as compared to a vacuum.

Paramagnetic materials are materials which have a relative permeability greater than one and up to about 10. Example of paramagnetic materials are aluminum, platinum, manganese, and chromium. Paramagnetic materials generally lose their magnetic properties immediately after an external magnetic field is removed.

Ferromagnetic materials are materials which provide a relative permeability greater than 10. Ferromagnetic materials include a variety of ferrites, iron, steel, nickel, cobalt, and commercial alloys, such as alnico and peralloy. Ferrites, for example, are made of ceramic material and have relative permeabilities that range from about 50 to 200.

As used herein, the term "magnetic particles" refers to particles when intermixed with dielectric materials, resulting in a relative permeability $\mu_r$ greater than 1 for the dielectric material. Accordingly, ferromagnetic and paramagnetic materials are generally included in this definition, while diamagnetic particles are generally not included. The relative permeability $\mu_r$ can be provided in a large range depending on the intended application, such as 1.1, 2, 3, 4, 6, 8, 10, 20, 30, 40, 50, 60, 80 100, or higher, or values in between these values.

Antenna performance can be improved when magnetic particles are used in the dielectric regions. A slot radiator of reduced size and improved efficiency is realized by the use of a relatively high dielectric constant. The dielectric also satisfies substantially the condition for maximum radiation efficiency into the air medium. The relative permeability and the relative permittivity (dielectric constant) are both equal to one in the air medium, that is $\mu_1=\in_1=1$. When the intrinsic impedance of the dielectric material located in slot radiator antenna is equal to the intrinsic impedance of free space, the radiation efficiency is substantially maximized. This condition is implemented when the relative permeability of the dielectric material in the slot radiator antenna is given by $\mu_2=(\in_2/\in_1)*\mu_1$, where $\in_2$ is the dielectric constant at the slot radiator.

A slot fed microstrip antenna includes an electrically conducting ground plane, the ground plane having at least one slot, and a feed line for transferring signal energy to or from the slot. A first dielectric substrate material is disposed between the feed line and the ground plane, wherein at least a portion of the first dielectric substrate includes magnetic particles. The antenna includes at least some of the magnetic particles disposed in a first junction between the feed line and the slot. The first dielectric layer can have a first set of dielectric properties including a first dielectric constant over a first portion, and at least a second portion having a second set of dielectric properties, the second set of dielectric properties providing a higher dielectric constant as compared to the first dielectric constant, wherein at least a portion of the first junction region includes the second portion. The first junction region can have a relative permeability of at least 1.1.

The first dielectric layer can include a ceramic material, the ceramic material having a plurality of voids, at least a portion of the voids filled with magnetic particles. The magnetic particles can be provided by meta-materials.

The antenna can be a slot fed microstrip patch antenna by including at least one patch radiator and a second dielectric layer, the second dielectric layer disposed between the ground plane and the patch radiator. At least a portion of the second dielectric layer can include magnetic particles. Some of the magnetic particles can be disposed in a second junction region between the slot and the patch radiator. The second dielectric layer can have a first set of dielectric properties including a first dielectric constant over a first portion, and at least a second portion having a second set of dielectric properties, the second set of dielectric properties providing a higher dielectric constant as compared to the first dielectric constant, wherein at least a portion of the second junction region includes the second portion. The second dielectric layer can include a ceramic material having a plurality of voids, at least a portion of the voids filled with the magnetic particles.

The magnetic particles can be provided by metamaterials. The antenna can have multiple patches, such as a first and a second patch radiator, the first and the second patch radiators separated by a third dielectric layer. At least a portion of the third dielectric material can include magnetic particles. The magnetic particles can be disposed in a third junction region between the first and the second patch radiator. The third dielectric layer can have a first set of dielectric properties including a first dielectric constant over a first portion, and at least a second portion having a second set of dielectric properties, the second set of dielectric properties providing a higher dielectric constant as compared to the first dielectric constant, wherein at least a portion of the third junction region includes the second portion.

DETAILED DESCRIPTION OF THE PREFERRED EMBODIMENTS

Figure 1:
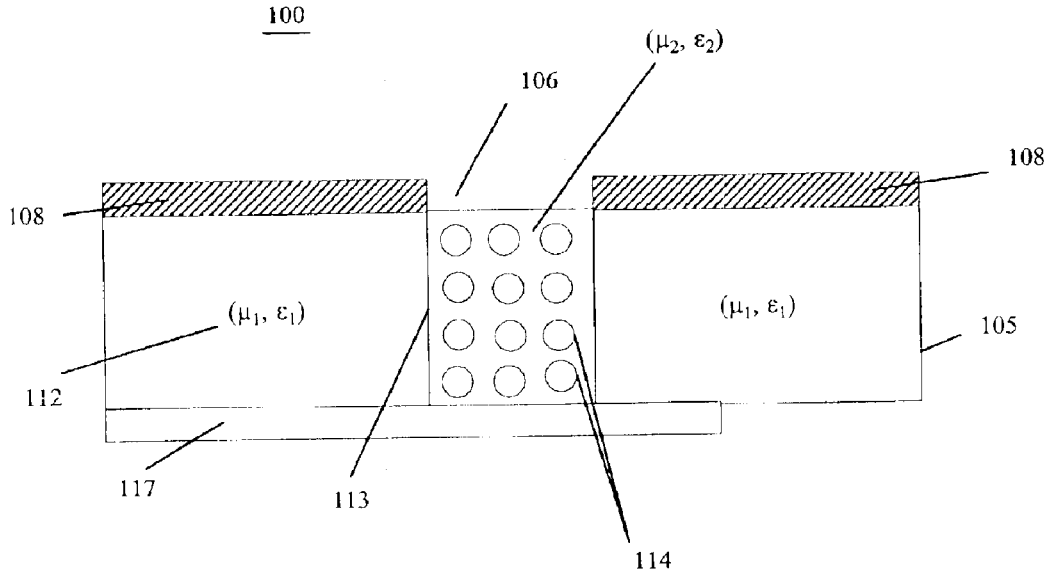
FIG. 1 is a side view of a slot fed microstrip antenna formed on a dielectric which includes magnetic particles in the junction region between the feed line and the slot and magnetic particles for maintenance of the intrinsic impedance of the feed line, according to an embodiment of the invention.

Low dielectric constant board materials are ordinarily selected for RF designs. For example, polytetrafluoroethylene (PTFE) based composites such as RT/duroid® 6002 (dielectric constant of 2.94; loss tangent of 0.0012) and RT/duroid® 5880 (dielectric constant of 2.2; loss tangent of 0.0007) are both available from Rogers Microwave Products, Advanced Circuit Materials Division, 100 S. Roosevelt Ave, Chandler, Ariz. 85226. Both of these materials are common board material choices. The above board materials are uniform across the board area in terms of thickness and physical properties and provide dielectric layers having relatively low dielectric constants with accompanying low loss tangents. The relative permeability of both of these materials is near 1.

Prior art antenna designs utilize mostly uniform dielectric materials. Uniform dielectric properties necessarily compromise antenna performance. A low dielectric constant substrate is preferred for transmission lines due to loss considerations and for antenna radiation efficiency, while a high dielectric constant substrate is preferred to minimize the size of the antenna size and optimize the energy coupling. Thus, inefficiencies and trade-offs necessarily result in the design of slot fed microstrip patch antennas.

Even when separate substrates are used for the antenna and the feed line, the uniform dielectric properties of each substrate generally compromises antenna performance. For example, a substrate with a low dielectric constant in slot feed antennas reduces the feed line loss but results in poor energy transfer efficiency from the feed line through the slot due to the higher dielectric constant in the slot region.

By comparison, the present invention provides the circuit designer with an added level of flexibility by permitting the use of dielectric layers, or portions thereof, with selectively controlled dielectric constant and permeability properties which can permit the circuit to be optimized to improve the efficiency, the functionality and the physical profile of the antenna.

The tunable and localizable electric and magnetic properties of the dielectric substrate may be realized by including metamaterials in the dielectric substrate. The term "metamaterials" refers to composite materials formed from the mixing of two or more different materials at a very fine level, such as the molecular or nanometer level.

According to the present invention, a slot fed microstrip antenna design is presented that has improved efficiency over prior art slot fed microstrip antenna designs. The improvement results primarily from improved coupling of electromagnetic energy between the feed line and the slot. The dielectric layer between the feed line and the slot includes magnetic particles, the magnetic particles preferably included in the dielectric junction region between the feed line and the slot. A high dielectric constant in this junction region can also be provided to further enhance the field concentration effect while the dielectric constant of the dielectric substrate proximate to the feed lines can have a lower dielectric constant, thus further increasing the efficiency of the antenna.

Referring to FIG. 1, a side view of a slot fed microstrip antenna 100 according to an embodiment of the invention is presented. Antenna 100 includes a substrate dielectric layer 105. Substrate 105 includes the first dielectric region 112 and the second dielectric region 113, the second dielectric region 113 disposed in the junction region between the feed line 117 and ground plane 108, the ground plane 108 including slot 106. First dielectric region 112 has a relative permeability $\mu_1$ and relative permittivity (or dielectric constant) $\in_1$. while the second dielectric region 113 has a relative permeability of $\mu_2$ and a relative permittivity of $\in_2$.

Feed line 117 is provided for transferring signal energy to or from slot radiator 106. Feed line 117 may be a microstrip line 117, or other suitable feed and may be driven by a variety of sources via a suitable connector and interface. The second dielectric region 113 includes a plurality of magnetic particles 114 disposed therein. Magnetic particles 114 can be metamaterial particles, which can be inserted into voids created in substrate 105, such as a ceramic substrate, as discussed in detail later. Antenna 100 can include an optional dielectric cover disposed over the ground plane 108 (not shown).

Although the ground plane 108 is shown as having a single slot 106, the invention is compatible with multi-slot arrangements. Multi-slot arrangements can be used to generate two or more (e.g. dual) polarizations. In addition, slots may generally be of any shape that provides coupling between feed line 117 and slot 106, such as rectangular or annular.

The second dielectric region 113 can significantly influence the electromagnetic fields radiated between the feed line 117 and the slot 106. Careful selection of the dielectric region 113 material, size, shape, and location can result in improved coupling between the feed line 117 and the slot 106, even with substantial distances therebetween.

In a preferred embodiment, second dielectric region 113 can have a higher dielectric constant $\in_2$ as compared to the dielectric constant $\in_1$ in first dielectric region 112 ($\in_2 > \in_1$). For example, the dielectric constant in first dielectric region 112 can be 2 to 3, while the dielectric constant in second dielectric region 113 can be at least 4. For example, the dielectric constant of dielectric region 113 can be 4, 6, 8, 10, 20, 30, 40, 50, 60 or higher, or values in between these values.

One problem in the prior art with increasing the dielectric constant in the dielectric region beneath the radiating regions, such as slot 106, is that the radiation efficiency of the antenna 100 may be reduced as a result. Slotted microstrip patch antennas printed on high dielectric constant and relatively thick substrates tend to exhibit poor radiation efficiency. With dielectric substrates having higher values of dielectric constants, a larger amount of the electromagnetic field is concentrated in second dielectric region 113.

The present invention allows magnetic particles 114 to be included within dielectric materials, such as the second dielectric region 113. Magnetic particles can provide dielectric substrates regions having relative magnetic permeabilities great than one. Conventional dielectric substrates materials have a relative magnetic permeability of approximately 1. Using methods described herein, $\mu_r$ can be provided in a wide range depending on the intended application, such as 1.1, 2, 3, 4, 6, 8, 10, 20, 30, 40, 50, 60, 80 100, or higher, or values in between these values.

The ability to selectively increase the relative permeability in portions of dielectric substrates can be used to allow the use of a high dielectric constants which reduces the size of slot fed microstrip antenna 100, can improve the coupling between the feed line 117 and the slot 106, as well as improve the impedance match of the antenna 100 to the free space (e.g. air). For example, in an idealized case, the maximum radiation efficiency into air results when the intrisic impedance of dielectric region 113 matches that of air, air having an intrinsic impedance near that of free space. Thus, in an idealized case, when the relative permeability $\mu_1$ is equal to the relative permittivity $\in_1$ at the dielectric/air interface, that is, $\mu_1 = \in_1$, there is a good impedance match with the air medium.

In addition, the antenna efficiency can be further improved by matching the intrinsic impedance of the transmission line region 112 to the slot dielectric region 113, specifically by selecting a relative permeability $\mu_2$ for medium 112 equal to $\mu_2 = \in_2 / \in_1 * \mu_1$. By using $\mu_1$ and $\mu_2$ values larger than one through use of magnetic particles, the size of antenna 100 may also be reduced further than available slot antennas.

Impedance matching concepts become less obvious when a given dielectric medium bounds two or more dissimilar dielectric mediums. In the case where a given dielectric medium bounds just two (2) dielectric mediums, the given dielectric medium can have permeability and permittivity values selected so as to match to a first medium (e.g. air), while also providing a quarter wave matching section to provide impedance matching to the second medium. This case is covered in the Examples.

However, when a given dielectric medium bounds three or more dissimilar dielectric mediums, such as in the case of some patch antennas, the situation becomes substantially more complex. In this case, computer modeling using numerous iterations of combinations of permittivity and permeability are generally necessary to maximize antenna efficiency. A starting point which can be used involves selecting a permittivity value within the middle range of permittivity values provided by the dielectric mediums bounding the given dielectric medium. The permeability of the given medium can then be adjusted using numerous iterations to optimize the antenna efficiency. Of course, those skilled in the art will recognize that the optimal values in any particular case will be dependent upon a variety of factors including the precise nature of the dielectric structure above and below the antenna elements, the dielectric and the conductive structure surrounding the antenna elements, the height of the antenna above the ground plane, the area of the slot, and so on. Accordingly, a suitable combination of optimum values for the permittivity and the permeability can be determined experimentally and/or with computer modeling.

Figure 2:
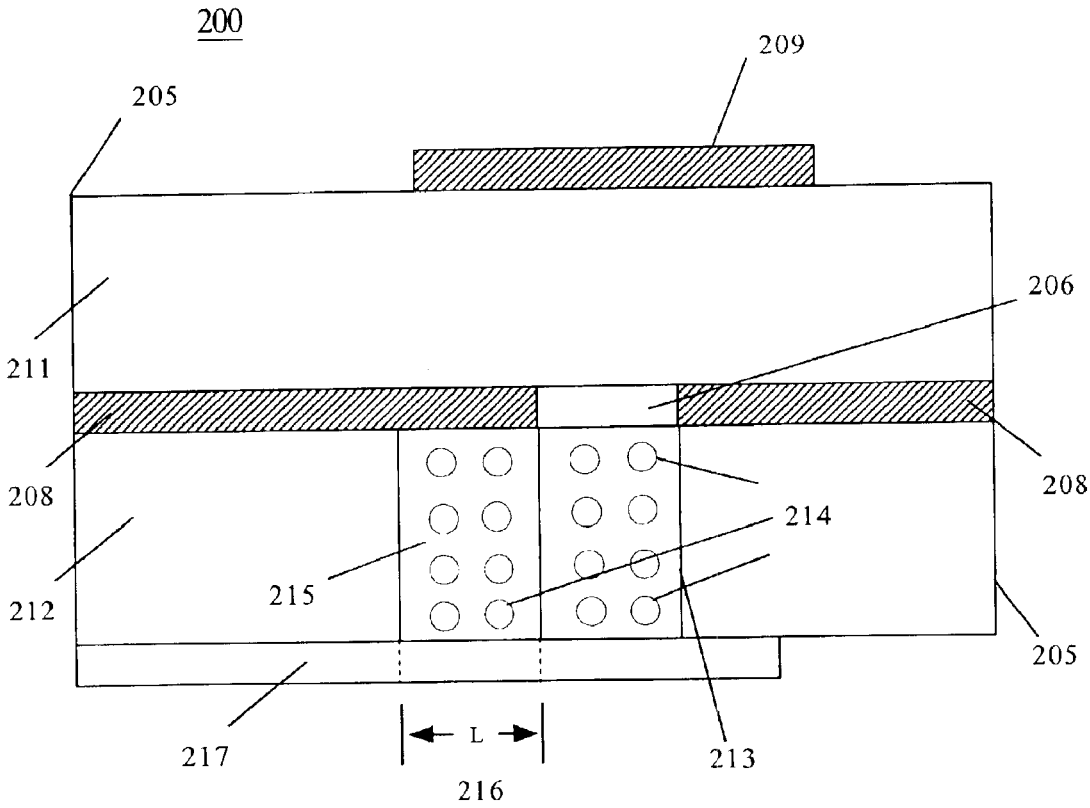
FIG. 2 is a side view of a slot fed microstrip patch antenna which includes a first dielectric material disposed between the ground plane and the patch, and a second dielectric material disposed between the ground plane and the feed line having magnetic particles in the junction region between the feed and the slot, according to another embodiment of the invention.

The invention can also be used to form slotted microstrip patch antennas having improved efficiency. FIG. 2 shows patch antenna 200, the patch antenna 200 including at least one patch radiator 209 and a second dielectric layer 211, the second dielectric layer disposed between the ground plane 208 and the patch radiator 209. The structure below the second dielectric layer 211 is the same as FIG. 1, except reference numbers have been renumbered as 200 series and a quarter wave matching section 216 has been added.

Antenna 200 achieves improved efficiency through enhanced coupling of electromagnetic energy between feed line 217 through slot 206 to patch 209 through use of magnetic particles 214 in dielectric region 213. As noted above, coupling efficiency can be further improved through use of a high dielectric constant in dielectric region 213. In a preferred embodiment, dielectric region 213 has a higher dielectric constant than the dielectric constant in dielectric region 212. For example, the dielectric constant in dielectric region 212 can be 2 to 3, while the dielectric constant in dielectric region 213 can be at least 4. In this way, the dielectric constant of dielectric region 213 can be 4, 6, 8, 10, 20, 30, 40, 50, 60 or higher, or values in between these values, while the relative permeability of dielectric region 213 can be 1.1, 2, 3, 4, 6, 8, 10, 20, 30, 40, 50, 60, 80 100, or higher, or values in between these values.

The second dielectric layer 211 preferably also includes magnetic particles. Inclusion of magnetic particles in the second dielectric layer 211 can be used to further improve antenna efficiency, even beyond the efficiency generally obtainable from antenna 200. As with other dielectric regions, the relative permeability of the second dielectric layer 211 can be 1.1, 2, 3, 4, 6, 8, 10, 20, 30, 40, 50, 60, 80 100, or higher, or values in between these values.

Figure 3:
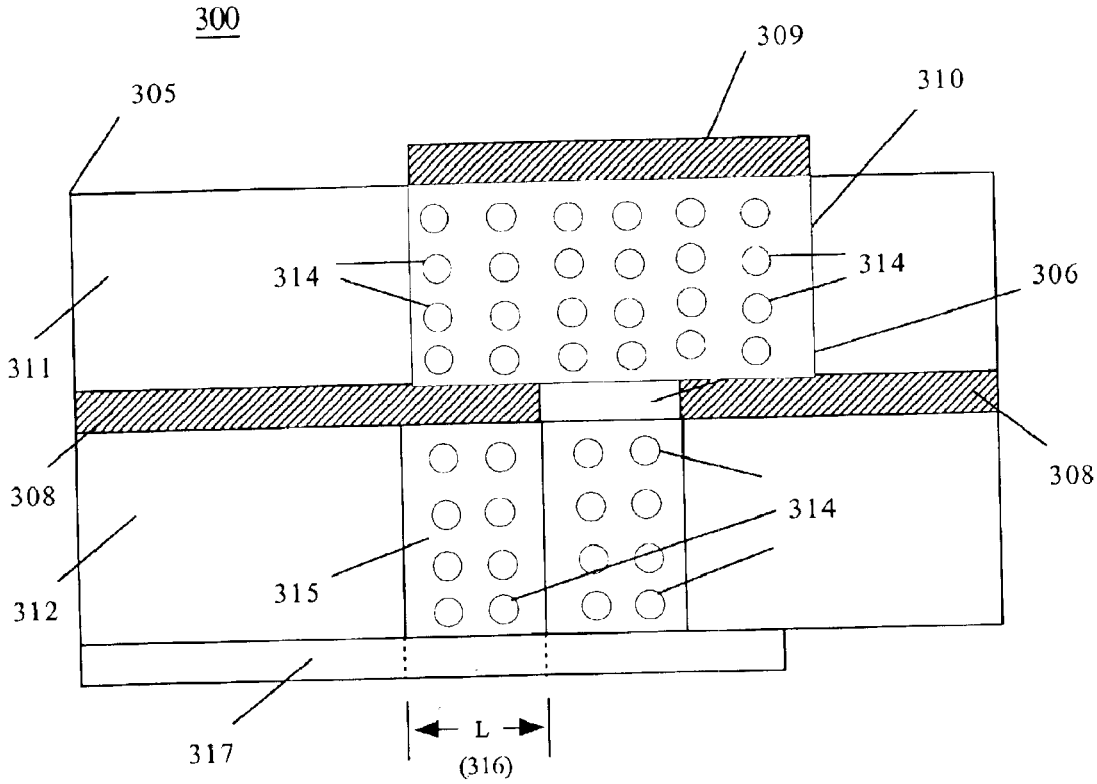
FIG. 3 is a side view of a slot fed microstrip patch antenna which includes a first dielectric material disposed between the ground plane and the patch, the first dielectric including magnetic particles, and a second dielectric disposed between the ground plane and the feed line which includes magnetic particles in the junction region between the feed and the slot, according to another embodiment of the invention.

FIG. 3 shows the slot fed microstrip patch antenna 300. The microstrip patch antenna 300 includes the same elements as antenna 200 shown in FIG. 2, except that magnetic particles 314 are disposed in the dielectric region 310, region 310 being proximate to the junction region between the slot 306 and the patch radiator 309.

The dielectric layer 318 can include a high dielectric constant dielectric region 310 and a lower dielectric constant dielectric region 311. For example, the dielectric constant in dielectric region 311 can be 2 to 3, while the dielectric constant in dielectric region 310 can be at least 4. In this way, the dielectric constant of dielectric region 310 can be 4, 6, 8, 10, 20, 30, 40, 50, 60 or higher, or values in between these values. The relative permeability of dielectric region 310 can be 1.1, 2, 3, 4, 6, 8, 10, 20, 30, 40, 50, 60, 80 100, or higher, or values in between these values.

Figure 4:
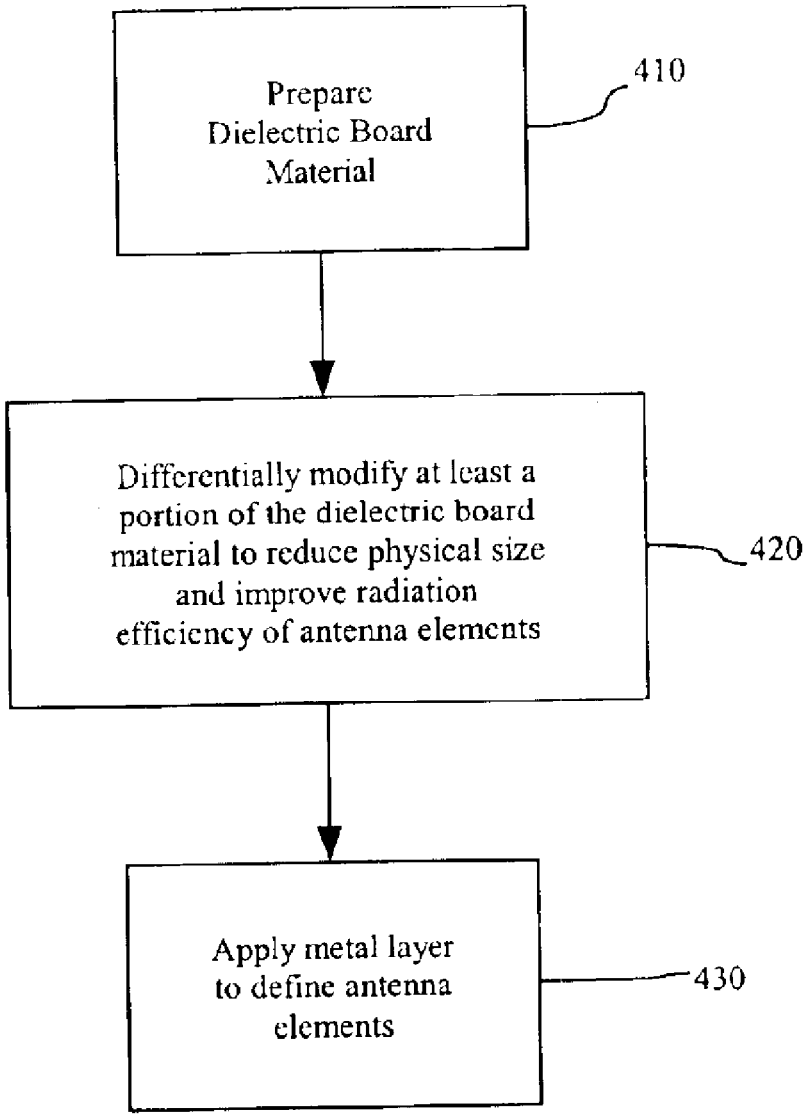
FIG. 4 is a flow chart that is useful for illustrating a process for manufacturing a slot fed microstrip antenna of reduced physical size and high radiation efficiency.

Dielectric substrate boards having metamaterial portions providing localized and selectable magnetic and dielectric properties can be prepared as shown in FIG. 4 for use as customized antenna substrates. In step 410, the dielectric board material can be prepared. In step 420, at least a portion of the dielectric board material can be differentially modified using meta-materials, as described below, to reduce the physical size and achieve the best possible efficiency for the antenna and associated circuitry. The modification can include creating voids in a dielectric material and filling some or substantially all of the voids with magnetic particles. Finally, a metal layer can be applied to define the conductive traces and surface areas associated with the antenna elements and associated feed circuitry, such as the patch radiators.

As defined herein, the term "meta-materials" refers to composite materials formed from the mixing or arrangement of two or more different materials at a very fine level, such as the angstrom or nanometer level. Metamaterials allow tailoring of electromagnetic properties of the composite, which can be defined by effective dielectric constant (or relative permittivity) and the effective relative permeability.

The process for preparing and modifying the dielectric board material as described in steps 410 and 420 shall now be described in some detail. It should be understood, however, that the methods described herein are merely examples and the invention is not intended to be so limited.

Appropriate bulk dielectric substrate materials can be obtained from commercial materials manufacturers, such as DuPont and Ferro. The unprocessed material, commonly called Green Tape™, can be cut into sized portions from a bulk dielectric tape, such as into 6 inch by 6 inch portions. For example, DuPont Microcircuit Materials provides Green Tape material systems, such as 951 Low-Temperature Cofire Dielectric Tape and Ferro Electronic Materials ULF28-30 Ultra Low Fire COG dielectric formulation. These substrate materials can be used to provide dielectric layers having relatively moderate dielectric constants with accompanying relatively low loss tangents for circuit operation at microwave frequencies once fired.

In the process of creating a microwave circuit using multiple sheets of dielectric substrate material, features such as vias, voids, holes, or cavities can be punched through one or more layers of tape. Voids can be defined using mechanical means (e.g. punch) or directed energy means (e.g., laser drilling, photolithography), but voids can also be defined using any other suitable method. Some vias can reach through the entire thickness of the sized substrate, while some voids can reach only through varying portions of the substrate thickness.

The vias can then be filled with metal or other dielectric or magnetic materials, or mixtures thereof, usually using stencils for precise placement of the backfill materials. The individual layers of tape can be stacked together in a conventional process to produce a complete, multi-layer substrate. Alternatively, individual layers of tape can be stacked together to produce an incomplete, multi-layer substrate generally referred to as a sub-stack.

Voided regions can also remain voids. If backfilled with selected materials, the selected materials preferably include metamaterials. The choice of a metamaterial composition can provide tunable effective dielectric constants over a relatively continuous range from 1 to about 2650. Tunable magnetic properties are also available from certain metamaterials. For example, through choice of suitable materials the relative effective magnetic permeability generally can range from about 4 to 116 for most practical RF applications. However, the relative effective magnetic permeability can be as low as about 2 or reach into the thousands.

A given dielectric substrate may be differentially modified. The term "differentially modified" as used herein refers to modifications, including dopants, to a dielectric substrate layer that result in at least one of the dielectric and magnetic properties being different at one portion of the substrate as compared to another portion. A differentially modified board substrate preferably includes one or more metamaterial containing regions. For example, the modification can be selective modification where certain dielectric layer portions are modified to produce a first set of dielectric or magnetic properties, while other dielectric layer portions are modified differentially or left unmodified to provide dielectric and/or magnetic properties different from the first set of properties. Differential modification can be accomplished in a variety of different ways.

According to one embodiment, a supplemental dielectric layer can be added to the dielectric layer. Techniques known in the art such as various spray technologies, spin-on technologies, various deposition technologies or sputtering can be used to apply the supplemental dielectric layer. The supplemental dielectric layer can be selectively added in localized regions, including inside voids or holes, or over the entire existing dielectric layer. For example, a supplemental dielectric layer can be used for providing a substrate portion having an increased effective dielectric constant. The dielectric material added as a supplemental layer can include various polymeric materials.

The differential modifying step can further include locally adding additional material to the dielectric layer or supplemental dielectric layer. The addition of material can be used to further control the effective dielectric constant or magnetic properties of the dielectric layer to achieve a given design objective.

The additional material can include a plurality of metallic and/or ceramic particles. Metal particles preferably include iron, tungsten, cobalt, vanadium, manganese, certain rare-earth metals, nickel or niobium particles. The particles are preferably nanometer size particles, generally having sub-micron physical dimensions, hereafter referred to as nanoparticles.

The particles, such as nanoparticles, can preferably be organofunctionalized composite particles. For example, organofunctionalized composite particles can include particles having metallic cores with electrically insulating coatings or electrically insulating cores with a metallic coating.

Magnetic metamaterial particles that are generally suitable for controlling magnetic properties of dielectric layer for a variety of applications described herein include ferrite organoceramics (FexCyHz)-(Ca/Sr/Ba-Ceramic). These particles work well for applications in the frequency range of 8–40 GHz. Alternatively, or in addition thereto, niobium organoceramics (NbCyHz)-(Ca/Sr/Ba-Ceramic) are useful for the frequency range of 12–40 GHz. The materials designated for high frequency are also applicable to low frequency applications. These and other types of composite particles can be obtained commercially.

In general, coated particles are preferable for use with the present invention as they can aid in binding with a polymer matrix or side chain moiety. In addition to controlling the magnetic properties of the dielectric, the added particles can also be used to control the effective dielectric constant of the material. Using a fill ratio of composite particles from approximately 1 to 70%, it is possible to raise and possibly lower the dielectric constant of substrate dielectric layer and/or supplemental dielectric layer portions significantly. For example, adding organofunctionalized nanoparticles to a dielectric layer can be used to raise the dielectric constant of the modified dielectric layer portions.

Particles can be applied by a variety of techniques including polyblending, mixing and filling with agitation. For example, a dielectric constant may be raised from a value of 2 to as high as 10 by using a variety of particles with a fill ratio of up to about 70%. Metal oxides useful for this purpose can include aluminum oxide, calcium oxide, magnesium oxide, nickel oxide, zirconium oxide and niobium (II, IV and V) oxide. Lithium niobate ($LiNbO_3$), and zirconates, such as calcium zirconate and magnesium zirconate, also may be used.

The selectable dielectric properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a dielectric constant of about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials generally have a range from 70 to 500+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a dielectric constant of about 2200 to 2650. Doping percentages for these materials are generally from about 1 to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organo functional materials, such as polytetrafluoroethylene PTFE.

Alternatively or in addition to organofunctional integration, processing can include solid freeform fabrication (SFF), photo, uv, x-ray, e-beam or ion-beam irradiation. Lithography can also be performed using photo, uv, x-ray, e-beam or ion-beam radiation.

Different materials, including metamaterials, can be applied to different areas on substrate layers (sub-stacks), so that a plurality of areas of the substrate layers (sub-stacks) have different dielectric and/or magnetic properties. The backfill materials, such as noted above, may be used in conjunction with one or more additional processing steps to attain desired, dielectric and/or magnetic properties, either locally or over a bulk substrate portion.

A top layer conductor print is then generally applied to the modified substrate layer, sub-stack, or complete stack. Conductor traces can be provided using thin film techniques, thick film techniques, electroplating or any other suitable technique. The processes used to define the conductor pattern include, but are not limited to standard lithography and stencil.

A base plate is then generally obtained for collating and aligning a plurality of modified board substrates. Alignment holes through each of the plurality of substrate boards can be used for this purpose.

The plurality of layers of substrate, one or more sub-stacks, or combination of layers and sub-stacks can then be laminated (e.g. mechanically pressed) together using either isostatic pressure, which puts pressure on the material from all directions, or uniaxial pressure, which puts pressure on the material from only one direction. The laminate substrate is then is further processed as described above or placed into an oven to be fired to a temperature suitable for the processed substrate (approximately 850° C. to 900° C. for the materials cited above).

The plurality of ceramic tape layers and stacked sub-stacks of substrates can then be fired, using a suitable furnace that can be controlled to rise in temperature at a rate suitable for the substrate materials used. The process conditions used, such as the rate of increase in temperature, final temperature, cool down profile, and any necessary holds, are selected mindful of the substrate material and any material backfilled therein or deposited thereon. Following firing, stacked substrate boards, typically, are inspected for flaws using an acoustic, optical, scanning electron, or X-ray microscope.

The stacked ceramic substrates can then be optionally diced into cingulated pieces as small as required to meet circuit functional requirements. Following final inspection, the cingulated substrate pieces can then be mounted to a test fixture for evaluation of their various characteristics, such as to assure that the dielectric, magnetic and/or electrical characteristics are within specified limits.

Thus, dielectric substrate materials can be provided with localized tunable dielectric and magnetic characteristics for improving the density and performance of circuits, including those comprising microstrip antennas, such as slot fed microstrip patch antennas.

EXAMPLES

Several specific examples dealing with impedance matching using dielectrics including magnetic particles according to the invention is now presented. Impedance matching from the feed into the slot, as well as the slot and the environment (e.g. air) is demonstrated.

The condition necessary for having equal intrinsic impedances at the interface between two different mediums, for a normally incidence ($\theta_i$=0°) plane wave, is given by $$\frac{\mu_n}{\varepsilon_n} = \frac{\mu_m}{\varepsilon_m}.$$

This equation is used in order to obtain an impedance match between the dielectric medium in the slot and the adjacent dielectric medium, for example, an air environment (e.g. a slot antenna with air above) or another dielectric (e.g. antenna dielectric in the case of a patch antenna). The impedance match into the environment is frequency independent. In many practical applications, assuming that the angle of incidence is zero is a generally reasonable approximation. However, when the angle of incidence is substantially greater than zero, cosine terms should be used along with the above equations in order to match the intrinsic impedance of two mediums.

The materials considered are all assumed to be isotropic. A computer program can be used to calculate these parameters. However, since magnetic materials for microwave circuits have not be used for matching the intrinsic impedance between two mediums before the invention, no reliable software currently exists for calculating the required material parameters necessary for impedance matching.

The computations presented were simplified in order to illustrate the physical principles involved. A more rigorous approach, such as a finite element analysis can be used to model the problems presented herein with additional accuracy.

Example 1

Slot with Air Above

Figure 5:
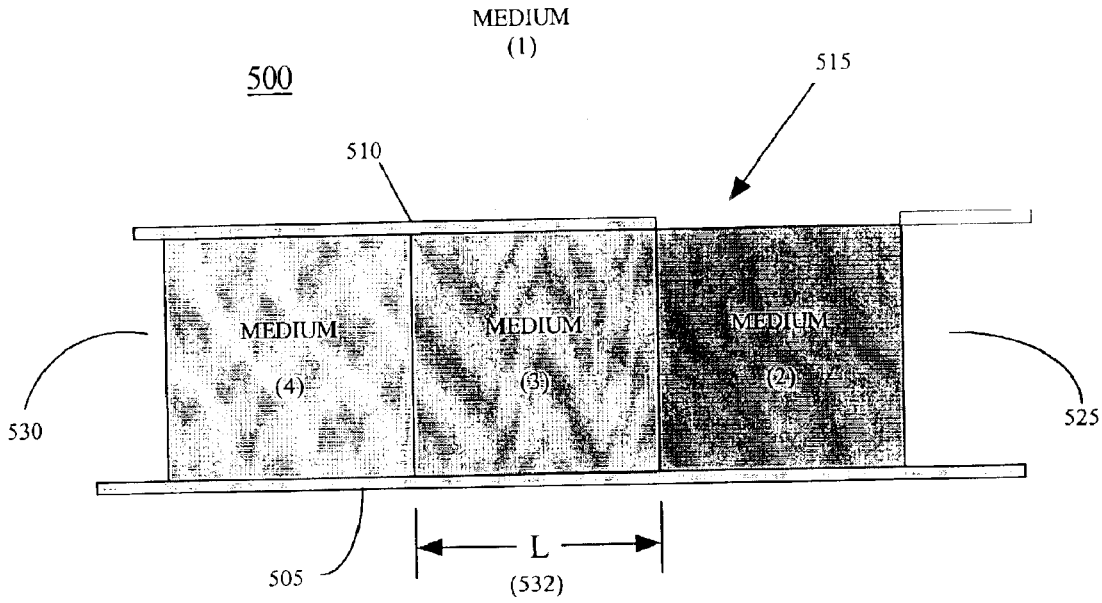
FIG. 5 is a side view of a slot fed microstrip antenna formed on an antenna dielectric which includes magnetic particles, the antenna providing impedance matching from the feed line into the slot, and the slot into the environment, according to an embodiment of the invention.

Referring to FIG. 5, a slot antenna 500 is shown having air (medium 1) above. Antenna 500 comprises transmission line 505 and ground plane 510, the ground plane including slot 515. A dielectric 530 having a dielectric constant $\in_r$=7.8 is disposed between transmission line 505 and ground plane 510 and comprises region/medium 4, region/medium 3 and region/medium 2. Region 3 has an associated length (L) which is indicated by reference 532. Region 525 is assumed to have little bearing on this analysis, and is thus neglected herein because it would add additional complexity not needed in order to explain the physical processes of interest.

The magnetic relative permeability values for medium 2 and 3 ($\mu_{r_2}$ and $\mu_{r_3}$) are determined by using the condition for the intrinsic impedance matching of mediums 2 and 3. Specifically, the relative permeability $\mu_{r_2}$ of medium 2 is determined to permit the matching of the intrinsic impedance of medium 2 to the intrinsic impedance of medium 1 (the environment). Similarly, the relative permeability $\mu_{r_3}$ of medium 3 is determined to permit the impedance matching of medium 2 to medium 4. In addition, the length L of the matching section in medium 3 is determined in order to match the intrinsic impedances of medium 2 and 4. The length of L is a quarter of a wavelength at the selected frequency of operation.

First, medium 1 and 2 are impedance matched to theoretically eliminate the reflection coefficient at their interface using the equation:

$$\frac{\mu_{r_1}}{\varepsilon_{r_1}} = \frac{\mu_{r_2}}{\varepsilon_{r_2}} \tag{1}$$

then the relative permeability for medium 2 is found as, $$\mu_{r_2} = \mu_{r_1}\frac{\varepsilon_{r_2}}{\varepsilon_{r_1}} = 1\cdot\frac{7.8}{1}\ \mu_{r_2} = 7.8 \tag{2}$$

Thus, to match the slot into the environment (e.g. air) the relative permeability $\mu_{r_2}$ of medium (2) is 7.8.

Next, medium 4 can be impedance matched to medium 2. Medium 3 is used to match medium 2 to 4 using a length (L) of matching section 532 in region 3 having an electrical length of a quarter wavelength at a selected operating frequency, assumed to be 3 GHz. Thus, matching section 432 functions as a quarter wave transformer. To match medium 4 to medium 2, a quarter wave section 532 is required to have an intrinsic impedance of:

$$\eta_3=\sqrt{\eta_2\cdot\eta_4} \tag{3}$$

The intrinsic impedance for region 2 is:

$$\eta_2 = \sqrt{\frac{\mu_{r_2}}{\varepsilon_{r_2}}}\,\eta_0 \tag{4}$$

where $\eta_0$ is the intrinsic impedance of free space, given by:

$$\eta_0=120\pi\Omega\approx377\Omega \tag{5}$$

hence, the intrinsic impedance $\eta_2$ of medium 2 becomes, $$\eta_2 = \sqrt{\frac{7.8}{7.8}}\cdot377\Omega = 377\Omega \tag{6}$$

The intrinsic impedance for region 4 is:

$$\eta_4 = \sqrt{\frac{\mu_{r_4}}{\varepsilon_{r_4}}}\,\eta_0 = \sqrt{\frac{1}{7.8}}\cdot377\Omega \approx 135\Omega \tag{7}$$

Substituting (0.7) and (0.6) in (0.3) gives the intrinsic impedance for medium 3, $$\eta_3=\sqrt{377\cdot135}\Omega=225.6\Omega \tag{8}$$

Then, the relative permeability in medium 3 is found as:

$$\eta_3 = 225.6\Omega = \sqrt{\frac{\mu_{r_3}}{\varepsilon_{r_3}}}\cdot\eta_0 = \sqrt{\frac{\mu_{r_3}}{7.8}}\cdot377 \tag{9}$$

$$\mu_{r_3} = 7.8\cdot\left(\frac{225.6}{377}\right)^2 = 2.79$$

The guided wavelength in medium 3 at 3 GHz, is given by $$\lambda_3 = \frac{c}{f}\frac{1}{\sqrt{\varepsilon_{r_3}\cdot\mu_{r_3}}} = \frac{3\times10^{10}\ \text{cm/s}}{3\times10^{9}\ \text{Hz}}\cdot\frac{1}{\sqrt{7.8\cdot2.79}} = 2.14\ \text{cm} \tag{10}$$

where c is the speed of light, and f is the frequency of operation. Consequently, the length (L) of quarter wave matching section 532 is given by $$L = \frac{\lambda_3}{4} = \frac{2.14}{4}\ \text{cm} = 0.536\ \text{cm} \tag{11}$$

Note that the reactance between mediums (2) and (3) must be zero, or very small, so that the impedance of medium (2) be matched to the impedance of medium (4) using a quarter wave transformer located in medium (3). This fact is well known in the theory of quarter wave transformers.

Example 2

Slot with Dielectric Above, the Dielectric Having a Relative Permeability of 1 and a Dielectric Constant of 10

Figure 6:
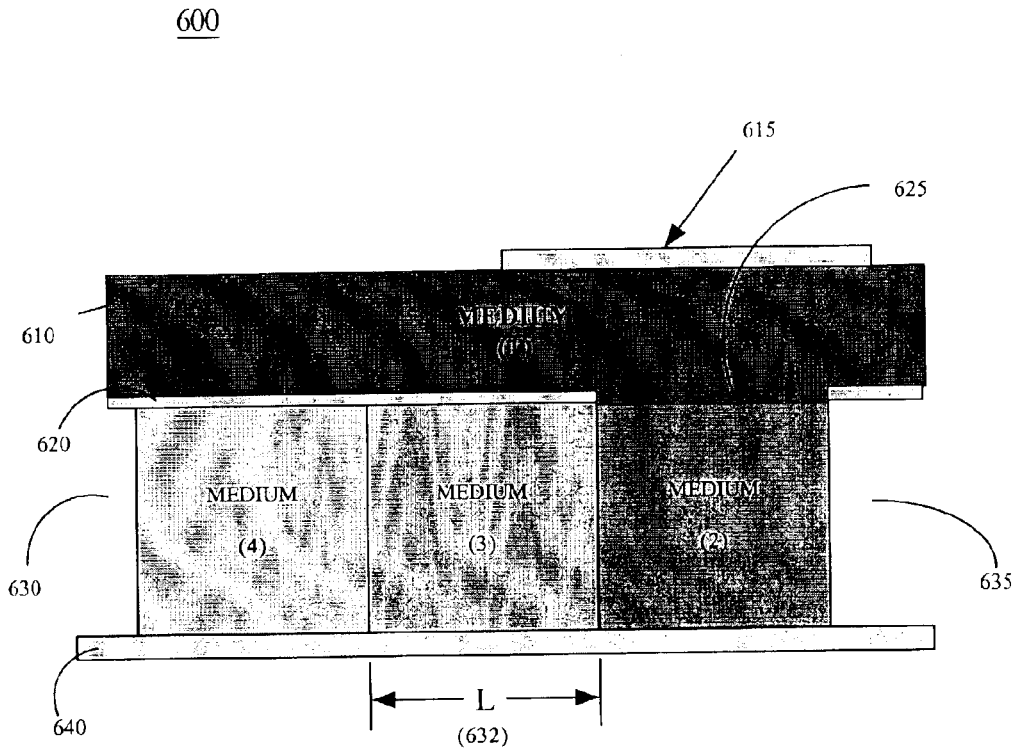
FIG. 6 is a side view of a slot fed microstrip patch antenna formed on an antenna dielectric which includes magnetic particles, the antenna providing impedance matching from the feed line into the slot, and the slot to its interface with the antenna dielectric beneath the patch, according to an embodiment of the invention.

Referring to FIG. 6, a side view of a slot fed microstrip patch antenna 600 is shown formed on an antenna dielectric 610 which provides a dielectric constant $\in_r$=10 and a relative permeability $\mu_r$=1. Antenna 600 includes the microstrip patch antenna 615 and the ground plane 620. The ground plane 620 includes a cutout region comprising a slot 625. The feed line dielectric 630 is disposed between ground plane 620 and microstrip feed line 640.

The feed line dielectric 630 comprises region/medium 4, region/medium 3 and region/medium 2. Region/medium 3 has an associated length (L) which is indicated by reference 632. Region 635 is assumed to have little bearing on this analysis and is thus neglected.

Since the relative permeability of the antenna dielectric is equal to 1 and the dielectric constant is 10, the antenna dielectric is clearly not matched to air as equal relative permeability and dielectric constant, such as $\mu_r$=10 and $\in_r$=10 for the antenna dielectric would be required. Although not demonstrated in this example, such a match can be implemented using the invention. In this example, the relative permeability for mediums 2 and 3 are calculated for optimum impedance matching between mediums 2 and 4 as well as between mediums 1 and 2. In addition, a length of the matching section in medium 3 is then determined which has a length of a quarter wavelength at a selected operating frequency. In this example, the unknowns are again the relative permeability $\mu_{r_2}$, of medium 2, the relative permeability $\mu_{r_3}$ of medium 3 and L. First, using the equation $$\frac{\mu_{r_1}}{\varepsilon_{r_1}} = \frac{\mu_{r_2}}{\varepsilon_{r_2}} \tag{12}$$

the relative permeability in medium 2 is:

$$\mu_{r_2} = \mu_{r_1}\frac{\varepsilon_{r_2}}{\varepsilon_{r_1}} = 1\cdot\frac{7.8}{10}\ \mu_{r_2} = 0.78 \tag{13}$$

In order to match medium 2 to medium 4, a quarter wave section 632 is required with an intrinsic impedance of $$\eta_3=\sqrt{\eta_2\cdot\eta_4} \tag{14}$$

The intrinsic impedance for medium 2 is $$\eta_2 = \sqrt{\frac{\mu_{r_2}}{\varepsilon_{r_2}}}\,\eta_0 \tag{15}$$

where $\eta_0$ is the intrinsic impedance of free space, given by $$\eta_0=120\pi\Omega\approx377\Omega \tag{16}$$

Hence, the intrinsic impedance $\eta_2$ of medium 2 becomes, $$\eta_2 = \sqrt{\frac{0.78}{7.8}}\cdot377\Omega = 119.2\Omega \tag{17}$$

The intrinsic impedance for medium 4 is $$\eta_4 = \sqrt{\frac{\mu_{r_4}}{\varepsilon_{r_4}}}\,\eta_0 = \sqrt{\frac{1}{7.8}}\cdot377\Omega \approx 135\Omega \tag{18}$$

Substituting (0.18) and (0.17) in (0.14) gives the intrinsic impedance for medium 3 of $$\eta_3=\sqrt{119.2\cdot135}\Omega=126.8\Omega \tag{19}$$

Then, the relative permeability for medium 3 is found as $$\eta_3 = 126.8\Omega = \sqrt{\frac{\mu_{r_3}}{\varepsilon_{r_3}}}\cdot\eta_0 = \sqrt{\frac{\mu_{r_3}}{7.8}}\cdot377 \tag{20}$$

$$\mu_{r_3} = 7.8\cdot\left(\frac{126.8}{377}\right)^2 = 0.8823$$

The guided wavelength in medium (3), at 3 GHz, is given by $$\lambda_3 = \frac{c}{f}\frac{1}{\sqrt{\varepsilon_{r_3}\cdot\mu_{r_3}}} = \frac{3\times10^{10}\ \text{cm/s}}{3\times10^{9}\ \text{Hz}}\cdot\frac{1}{\sqrt{7.8\cdot0.8823}} = 3.81\ \text{cm} \tag{21}$$

where c is the speed of light and f is the frequency of operation. Consequently, the length L is given by $$L = \frac{\lambda_3}{4} = \frac{3.81}{4}\ \text{cm} = 0.952\ \text{cm} \tag{22}$$

Since the relative permeability values required for impedance matching are substantially less than one, such matching will be difficult to implement with existing materials. Therefore, the practical implementation of this example will require the development of new materials tailored specifically for this or similar applications which require a medium having a relative permeability less than 1.

Example 3

Slot with Dielectric Above, that has a Relative Permeability of 10, and a Dielectric Constant of 20

This example is analogous to example 2, having the structure shown in FIG. 6, except the dielectric constant $\in_r$ of the antenna dielectric 610 is 20 instead of 1. Since the relative permeability of antenna dielectric 610 is equal to 10, and it is different from its relative permittivity, antenna dielectric 610 is again not matched to air. In this example, as in the previous example, the permeability for mediums 2 and 3 for optimum impedance matching between mediums 2 and 4 as well as for optimum impedance matching between mediums 1 and 2 are calculated. In addition, a length of the matching section in medium 3 is then determined which has a length of a quarter wavelength at a selected operating frequency. As before, the relative permeabilities $\mu_{r_2}$, of medium 2 and $\mu_{r_3}$ of medium 3, and the length L in medium 3 will be determined to match the impedance of adjacent dielectric media.

First, using the equation $$\frac{\mu_{r_1}}{\varepsilon_{r_1}} = \frac{\mu_{r_2}}{\varepsilon_{r_2}} \tag{23}$$

the relative permeability of medium 2 is found as, $$\mu_{r_2} = \mu_{r_1}\frac{\varepsilon_{r_2}}{\varepsilon_{r_1}} = 10 \cdot \frac{7.8}{20} = 3.9 \tag{24}$$

In order to match the impedance of medium 2 to medium 4, a quarter wave section is required with an intrinsic impedance of $$\eta_3 = \sqrt{\eta_2 \cdot \eta_4} \tag{25}$$

The intrinsic impedance for medium 2 is $$\eta_2 = \sqrt{\frac{\mu_{r_2}}{\varepsilon_{r_2}}}\,\eta_0 \tag{26}$$

where $\eta_0$ is the intrinsic impedance of free space, given by $$\eta_0 = 120\pi\Omega \approx 377\Omega \tag{27}$$

hence, the intrinsic impedance of medium 2 $\eta_2$ becomes, $$\eta_2 = \sqrt{\frac{3.9}{7.8}} \cdot 377\Omega = 266.58\Omega \tag{28}$$

The intrinsic impedance for medium (4) is $$\eta_4 = \sqrt{\frac{\mu_{r_4}}{\varepsilon_{r_4}}}\,\eta_0 = \sqrt{\frac{1}{7.8}} \cdot 377\Omega \approx 135\Omega \tag{29}$$

Substituting (0.29) and (0.28) in (0.25) gives the intrinsic impedance for medium 3, which is $$\eta_3 = \sqrt{266.58 \cdot 135}\Omega = 189.7\Omega \tag{30}$$

Then, the relative permeability for medium (3) is found as $$\eta_3 = 189.7\Omega = \sqrt{\frac{\mu_{r_3}}{\varepsilon_{r_3}}} \cdot \eta_0 = \sqrt{\frac{\mu_{r_3}}{7.8}} \cdot 377 \tag{31}$$

$$\mu_{r_3} = 7.8 \cdot \left(\frac{189.7}{377}\right)^2 = 1.975$$

The guided wavelength in medium 3, at 3 GHz, is given by $$\lambda_3 = \frac{c}{f}\frac{1}{\sqrt{\varepsilon_{r_3} \cdot \mu_{r_3}}} = \frac{3 \times 10^{10}\ \text{cm/s}}{3 \times 10^{9}\ \text{Hz}} \cdot \frac{1}{\sqrt{7.8 \cdot 1.975}} = 2.548\ \text{cm} \tag{32}$$

where c is the speed of light and f is the frequency of operation. Consequently, the length 632 (L) is given by $$L = \frac{\lambda_3}{4} = \frac{2.548}{4}\ \text{cm} = 0.637\ \text{cm} \tag{33}$$

Comparing examples 2 and 3, through use of an antenna dielectric 610 having a relative permeability substantially greater than 1 facilitates impedance matching between mediums 1 and 2, as well as between mediums 2 and 4, as the required permeabilities for medium 2 and 3 for matching these mediums are both readily realizable as described herein.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A slot fed microstrip antenna, comprising:

an electrically conducting ground plane, said ground plane having at least one slot;

a feed line for transferring signal energy to or from said slot;

a first dielectric substrate material disposed between said feed line and said ground plane, wherein at least a portion of said first dielectric substrate includes magnetic particles;

wherein at least some of said magnetic particles are disposed in a first junction between said feed line and said slot.

2. The antenna of claim 1, wherein said first dielectric layer has a first set of dielectric properties including a first dielectric constant over a first portion, and at least a second portion having a second set of dielectric properties, said second set of dielectric properties providing a higher dielectric constant as compared to said first dielectric constant, wherein at least a portion of said first junction region comprises said second portion.

3. The antenna of claim 1, wherein said first junction region has a relative permeability of at least 1.1.

4. A slot fed microstrip antenna comprising:

an electrically conducting ground plane, said ground plane having at least one slot;

a feed line for transferring signal energy to or from said slot;

a first dielectric substrate material disposed between said feed line and said ground plane, wherein at least a portion of said first dielectric substrate includes magnetic particles;

wherein said first dielectric layer comprises a ceramic material, said ceramic material having a plurality of voids, at least a portion of said voids filled with said magnetic particles.

5. A slot fed microstrip antenna, comprising:

an electrically conducting around plane, said ground plane having at least one slot;

a feed line for transferring signal energy to or from said slot;

a first dielectric substrate material disposed between said feed line an said ground plane, wherein at least a portion of said first dielectric substrate includes magnetic particles;

wherein said magnetic particles comprise meta-materials.

6. A slot fed microstrip antenna, comprising:

an electrically conducting ground plane, said around plane having at least one slot;

a feed line for transferring signal energy to or from said slot;

a first dielectric substrate material disposed between said feed line and said ground plane, wherein at least a portion of said first dielectric substrate includes magnetic particles; and at least one microstrip patch antenna radiator and a second dielectric layer, said second dielectric layer disposed between said ground plane and said patch radiator.

7. The antenna of claim 6, wherein at least a portion of said second dielectric layer includes magnetic particles.

8. The antenna of claim 7, wherein at least some of said magnetic particles are disposed in a second junction region between said slot and said patch radiator.

9. The antenna of claim 8, wherein said second dielectric layer has a first set of dielectric properties including a first dielectric constant over a first portion, and at least a second portion having a second set of dielectric properties, said second set of dielectric properties providing a higher dielectric constant as compared to said first dielectric constant, wherein at least a portion of said second junction region comprises said second portion.

10. The antenna of claim 7, wherein said second dielectric layer comprises a ceramic material, said ceramic material having a plurality of voids, at least a portion of said voids filled with said magnetic particles.

11. The antenna of claim 7, wherein said magnetic particles comprise meta-materials.

12. The antenna of claim 6, wherein said at least one microstrip patch antenna radiator comprises a first and a second microstrip patch radiator, said first and said second patch radiators separated by a third dielectric layer.

13. The antenna of claim 12, wherein at least a portion of said third dielectric material includes magnetic particles.

14. The antenna of claim 13, wherein at least some of said magnetic particles are disposed in a third junction region between said first and said second microstrip patch antenna radiator.

15. The antenna of claim 14, wherein said third dielectric layer has a first set of dielectric properties including a first dielectric constant over a first portion, and at least a second portion having a second set of dielectric properties, said second set of dielectric properties providing a higher dielectric constant as compared to said first dielectric constant, wherein at least a portion of said third junction region comprises said second portion.

* * * * *